US005117509A

United States Patent [19]

Bowers

[11] Patent Number: 5,117,509

[45] Date of Patent: Jun. 2, 1992

[54] SPORT GLOVE

[76] Inventor: Steven M. Bowers, Rte. 1, Box 208A, Joseph, Oreg. 97846

[21] Appl. No.: 549,356

[22] Filed: Jul. 5, 1990

[51] Int. Cl.[5] ..... A41D 19/00

[52] U.S. Cl. ..... 2/161 A; 2/169

[58] Field of Search ..... 2/161 R, 161 A, 16, 2/159, 169

[56] References Cited

U.S. PATENT DOCUMENTS

| | | | |
|---|---|---|---|
| Re. 22,167 | 8/1942 | Wells et al. | 2/161 R |
| Re. 31,538 | 3/1984 | Antonious | 2/161 A |
| 203,959 | 5/1978 | Townsend | 2/20 X |
| 1,179,871 | 4/1916 | St. John | 2/168 |
| 2,167,226 | 7/1939 | Wells et al. | 2/159 |
| 2,459,985 | 1/1949 | Woodbury | 2/161 |
| 2,465,136 | 3/1949 | Troccoli | 2/161 A |
| 2,907,046 | 10/1959 | Scherr | 2/159 |
| 3,096,523 | 7/1963 | Bruchas | 2/159 |
| 3,255,461 | 6/1966 | Bullock | 2/159 |
| 3,597,765 | 8/1971 | Stanton | 2/159 |
| 4,027,339 | 6/1977 | Brucker | 2/16 |
| 4,598,429 | 7/1986 | Mulvaney | 2/169 |
| 4,689,832 | 9/1987 | Mulvaney | 2/161 A |
| 4,691,387 | 9/1987 | Lopez | 2/161 |

OTHER PUBLICATIONS

Black and grey glove with embroidered intial "N" made by the Neumann Company (2 photos, front and back).

White nylon and leather back glove Circle-W-E (2 photos, front and back).

Yellow or orange fabric glove Wells Lamont Golden Gripper (2 photos, front and back).

Cloth glove with a white palm with green dots Boss Ladyfinger (2 photos, front and back).

Cloth garden glove having a green palm and colored pattern on back P.G.C. (2 photos, front and back).

"Action Prevention Equipment", The Safety Equipment Co., Jul. 31, 1943.

*Primary Examiner*—Werner H. Schroeder
*Assistant Examiner*—Sara M. Current
*Attorney, Agent, or Firm*—Stetina and Brunda

[57] ABSTRACT

An improved athletic glove having superior gripping properties is disclosed generally comprising a palm piece and a back piece joined together to fit the human hand. The palm piece is made of a sheet of leather material prepared by a chrome tanning process or synthetic leather material having a substantially continuous layer of silicone s ealant covering the palm side thereof. The layer of sealant is bonded to the palm side and does not penetrate through the palm side to the hand of a wearer.

6 Claims, 1 Drawing Sheet

SPORT GLOVE

FIELD OF THE INVENTION

The present invention relates generally to gloves for the human hand, and more particularly to a glove for use in conjunction with various athletic activities and special use activities, having a non-slip material specifically chosen and applied on the palm side thereof.

BACKGROUND OF THE INVENTION

As is well known, gloves adapted to fit the human hand have been used for work and for purposes relating to cold weather recreation for many years. Recently, however, gloves have also come into widespread use in sports such as football, baseball, and racquetball. Athletic gloves used in these sports are generally made of a very thin, supple material, such as split leather. Although such gloves were initially used as protection for the hands of the athlete against cold and injury, many athletes have come to believe that the use of properly-designed gloves can enhance their athletic performance.

One of the most essential characteristics of an athletic glove when used in sports related activities pertains to the gripping ability of the glove. Presently, an obstacle to even more widespread acceptance of gloves for use in many sports is the inability of currently-known and marketed gloves to provide an adequate grip under a wide range of conditions. In this regard, though many existing leather gloves can provide excellent feel, finger motion, protection and tactile response, the gripping characteristics of such gloves are generally significantly inferior to the bare human hand.

One category of currently-known athletic gloves comprise a back piece made of a synthetic stretch fabric and a palm piece made of leather which is thoroughly impregnated with a sticky liquid material. Although such "tackified" leather gloves are a significant improvement over the gripping ability of conventional leather gloves, such gloves have caused some wearers to complain about the somewhat wet, oily tacky feel of the interior of the glove against their skin attributable to the tacky material impregnating the leather palm material and thereby being present on both the inside and outside of the palm of the glove. In this respect, these gloves also tend to leave an objectionable tacky residue on the hand and on the objects with which the glove comes in contact.

Another category of athletic gloves use rubber as the major structural material. One such glove comprises a palm portion made of a web of foam neoprene rubber which is lines on the inside with a nylon material. Such nylon-lined foam neoprene is commonly used in wetsuits and wetsuit gloves intended for water sports such as scuba diving, water skiing and surfing. Though the neoprene foam palm of gloves of this prior art variety provides non-slip gripping characteristics under many conditions, the nylon lining of such gloves has a tendency to slip against the wearer's palm, thus interfering with the sureness and feel of the grip. Additionally, because of the non-absorbtivity of the nylon and the water-vapor barrier characteristics of the foam neoprene, sweaty palms are also a potential problem when using such gloves. Further, such neoprene material acts as an absorbant sponge collecting moisture during use which detracts from gripping strength.

One additional category of currently-known prior art gloves are work gloves which include mechanical means on characteristics. One such work glove comprises a cotton work glove which includes a plurality of small dots of polymer material disposed on the palm piece to facilitate improved gripping. Such a glove however is unsatisfactory for sports situations due to the limited tactile characteristics of the glove, the tendency of cotton to slip against the skin, interference with the dexterity of the wearer, and the tendency of the small polymer dots on the palm to pull off of the glove.

Accordingly, there is a substantial need in the art for an athletic glove having improved gripping characteristics without the drawbacks associated with many prior art gloves.

SUMMARY OF THE INVENTION

In accordance with the preferred embodiment of the present invention, there is provided an improved athletic glove having superior gripping characteristics. The glove generally comprises a palm piece and a back piece which are joined together to fit a human hand. The palm piece includes a palm face portion and five finger stall portions preferably fabricated from a sheet of leather or synthetic suede leather. In the preferred embodiment, the sheet of leather is prepared by a chrome tanning process so as to reduce the oil content therein and has moisture absorption properties so as to prevent slippage against the hand of a wearer when the glove is being utilized during an athletic activity.

Bonded to a substantial portion of the palm piece is a continuous, thin layer of silicone sealant. Importantly, the silicone sealant is applied to the palm piece only and is not applied to the back piece of the glove. The layer of sealant is applied so as to be partially penetrating, i.e. bonded to the palm piece but not to penetrate the palm piece so as to come in contact with the hand of the wearer thereby preserving the moisture-absorbing capacity of the material against the wearer's hand. The silicone sealant layer serves to impart improved gripping, tactile and flexibility properties as well as improved chemical, flame and thermal resistivity properties to the palm piece of the glove for athletic endeavors and special use applications such as aviating flight gloves while simultaneously preventing the passage of moisture therethrough. In the preferred embodiment, the inside surface of the palm piece includes a grain finish while the outside surface has a split finish. In this regard, the split finish aids in the bonding process when the layer of silicone sealant is applied thereto. The bonding process is further enhanced by the reduced oil content of the leather attributable to the chrome tanning process. The palm piece may alternatively be fabricated from a sheet of synthetic suede also having reduced oil properties. As will be appreciated, though in the preferred embodiment the entire palm piece is coated with a layer of silicone sealant, the palm face portion may be coated without coating the finger stall portions to provide a glove having superior gripping characteristics.

The athletic glove made in accordance with the present invention comprises a thin, durable, form-fitting glove having superior grip characteristics over currently-known and marketed athletic gloves. In this regard, the thin, uniform layer of silicone sealant material forming a continuous coating covering palm piece of the glove provides a sure, natural feel and tactile response not found in other gloves. The glove of the present invention further eliminates slipping against the fingers of the wearer and leaves no sticky residue on the hand or on the objects being handled by the wearer of the glove since the sealant layer does not come in contact with the user's hand. The combination of these properties makes the glove of the present invention ideal for both professional and amateur sports in which manual dexterity is paramount.

As such, an object of the present invention is to provide an athletic glove having improved gripping characteristics.

Another object of the present invention is to provide an athletic glove which does not slip against the wearer's palm.

A further object of the present invention is to provide an athletic glove which does not inhibit finger motion, feel, or tactile response.

Further objects and advantages of the present invention will become apparent to those skilled in the art upon reading and consideration of the following description a preferred embodiment in the accompanying drawings.

BRIEF DESCRIPTION OF THE DRAWINGS

These as well as other features of the present invention will become apparent upon reference to the drawings wherein.

DETAILED DESCRIPTION OF THE PREFERRED EMBODIMENT

Figure 1:
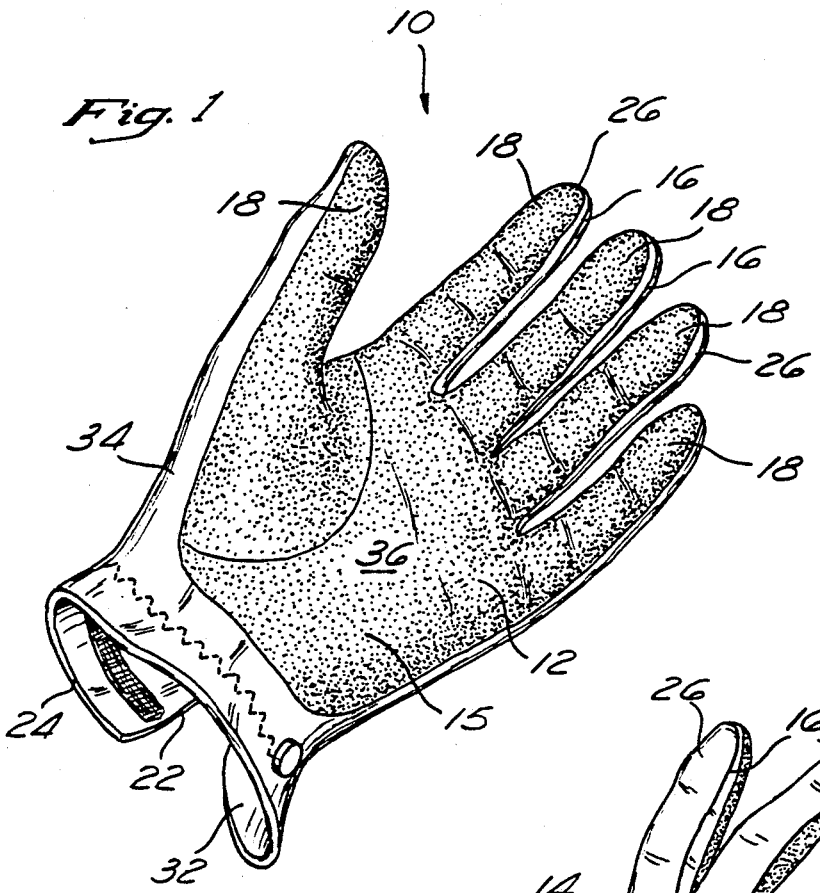
FIG. 1 is a perspective view of the palm piece of the glove of the present invention, particularly illustrating the palm face portion and the finger stall portions.
Figure 2:
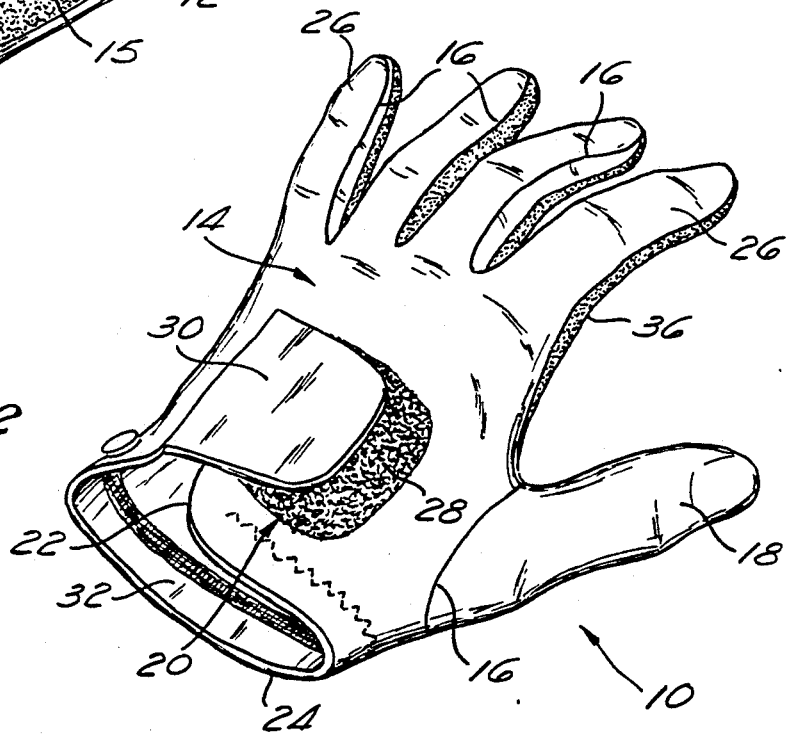
FIG. 2 is a perspective view of the back piece of the glove of the present invention, particularly illustrating the fastening element thereon.

Referring now to the drawings wherein the depictions are for purposes of illustrating a preferred embodiment of the present invention only and not for the purposes of limiting the same, FIGS. 1 and 2 perspectively illustrate the glove 10 of the present invention. Glove 10 is generally comprised of a palm piece 12 and a back piece 14. Glove 10 is adapted to snugly fit the human hand such that palm piece 12 lies tightly against the palm of the hand while back piece 14 lies tightly against the back of the hand. Palm piece 12 and back piece 14 are preferably joined by at least one seam 16 in a conventional, substantially continuous manner around the glove. Palm piece 12 further comprises a palm face portion 15 and five finger stall portions 18. When palm piece 12 and back side 14 are joined, a wrist edge 24 and finger portion 26 are provided in a conventional manner.

As best seen in FIG. 2, a fastener device 20 is provided in order to facilitate a firm and secure fit of glove 10 to the hand of the wearer. In the preferred embodiment, back piece 14 of glove 10 is provided with a split 22 which extends from the wrist edge 24 of glove 10 in the direction of fingers 26. Preferably the length of split 22 is three to six centimeters. Advantageously, split 22 may be adjustably drawn together and/or closed with a closure member 30 which traverses split 22. Closure member 30 preferably comprises a strap or flap which may be secured with an appropriate securing material 28 such as the hook-and-loop closure material sold under the trademark VELCRO. It will be appreciated, however, that any suitable fastening device may be utilized as an alternative to that as previously described.

Palm piece 12 and back piece 14 of glove 10 may be made of the same materials or of different materials, depending upon the users preference and the application in which the glove is to be used. Particularly suitable materials for palm piece 12 include natural leather and artificial leather. In the preferred embodiment of the present invention, palm piece 12 comprises a sheet of leather including an inside surface 32 having a grain finish and an outside surface 34 having a split finish. Importantly, the sheet of leather is prepared by a chrome tanning process. The chrome tanning process which utilizes a solution of basic chrome sulfate has the advantage of providing a reduced oil content within the leather which is important for reasons which will be discussed in greater detail below. Because glove 10 is intended to provide a secure grip for an individual undergoing physical sport endeavors, it must be able to cope with the perspiration on the palm of the hand. In this respect, it is important that the sheet of leather from which palm piece 12 is fabricated have the ability to absorb perspiration from the palm of the hand. Such moisture absorption and wicking characteristics may be provided by the mioroporous structure of the material. Additionally, the sheet of leather must be sufficiently thin and supple so as not to interfere with the finger movements of the wearer during an athletic activity. Moreover, the sheet must provide a tactile response to the wearer from the objects which the wearer is handling. In this regard, a thin sheet of leather material is preferred. As previously stated, artificial leather, such as synthetic suede, which has water absorbtivity and wicking characteristics similar to that of leather may be utilized as an alternative to leather. As previously stated, back piece 14 of glove 10 may be made of the same materials as those disclosed for palm piece 12. In addition, back piece 14 may alternately be fabricated from any other suitable flexible, supple, form-fitting material, including woven and knit fabric polyester, and polypropylene, in the form of a stretohable fabric, are particularly suitable because of their light weight, flexibility and durability. Moreover, because of the porous nature of such fabric materials, such materials do not tend to trap perspiration inside glove 10, but rather permit such perspiration to freely evaporate.

As can be easily appreciated, when worn by a user, inside surface 32 of palm piece 12 lies against the human palm of the wearer while outside surface 34 comes into physical contact with objects handled by the wearer. In order to enhance and facilitate the gripping characteristics of glove 10 for recreational and sports use, a layer of non-slip material 36 is coated on outside surface 34 of palm piece 12. In the preferred embodiment of the present invention, material 36 is placed on both palm face portion 15 and finger stall portions 18 though it will be appreciated that such material may be placed only on palm face portion 15 and still enhance the gripping characteristics of glove 10.

In the preferred embodiment, the applicant has found that superior results are achieved by use of a silicone sealant compound for material 36. Such silicone sealant offers superior adhesion to split leather surfaces as well as possesses superior elasticity necessary for continuous sport endeavors. Further such silicone sealant possesses significant chemical, fire and thermal resistivity and yields a tacky but non-yielding tactile feel. In the preferred embodiment, a Dow Corning general purpose, one-part silicone sealant is utilized, however, other silicone sealants having similar properties are contemplated herein. (Dow Corning is a registered trademark of Dow Corning Corporation, Midland, Mich.)

Figure 3:
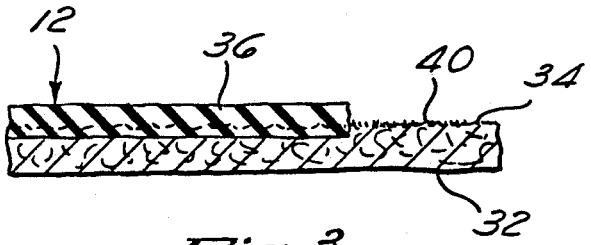
FIG. 3 is a cross-sectional view of a portion of the material making up the palm piece of the glove of the present invention, particularly illustrating the silicone sealant layer on the palm piece material.

Referring now to FIG. 3, in the preferred embodiment, outside surface 34 of palm piece 12 has a split finish defining a plurality of exposed fibers 40. Such a fibrous structure is advantageous due to the mechanical interconnection that takes place between fibers 40 and material 36 thereby enhancing the bonding process therebetween. Additionally, because the sheet of leather material comprising palm piece 12 is microporous material, outside surface 34 may be coated with material 36 as also shown in FIG. 3. Importantly, however, material 36 does not penetrate the entire thickness of palm piece 12. As seen in FIG. 3, material 36 is mechanically bonds to the exposed fibers of the split finish outside surface 34 into a small portion of the underlying, microporous body of palm piece 12. As such, the penetration is limited to less than the entire thickness of the material and preferably only a fraction of the thickness such being less than 25 percent. In this regard, substantial moisture absorbing or wirking capability is retained by inside surface 32 of palm piece 12 thereby providing greater comfort and improved feel for the wearer. Additionally, the thickness of the material 36 and the geometry in which it is applied to outside surface 34 are important considerations if glove 10 is to be successfully used as a sports glove. Thus, material 36 is applied to palm piece 12 in a continuous layer thereby covering both the palm face portion 15 and finger stall portions 18 of outside surface 34. Moreover, in order to provide a skin-like tactile response, the layer of material 36 must be thin and smooth. The thickness of material 36 should be generally uniform over the entire outside surface 34 of palm piece 12. Material 36 is applied to outside surface 34 of palm piece 12 in any suitable manner. Such application may be carried out either before or after assembly of palm piece 12 to back piece 14 and may be accomplished by spraying, spreading, or otherwise coating outside surface 34.

Additional modifications and improvements of the invention may also be apparent to those skilled in the art. Thus, the particular combination of parts described and illustrated herein is intended to represent only one embodiment of the invention, and is not intended to serve as limitations of alternative devices within the spirit and scope of the invention. Further, those skilled in the art will recognize that the sport glove defined and claimed herein is additionally applicable for other non-sport, special use endeavors requiring improved gripping strength such as aviation flight gloves and the like and for purposes of this application the term sport glove shall be defined to encompass such broader meaning.

What is claimed is:

1. An athletic glove comprising:

a palm piece and a back piece joined together to fit a human hand, wherein said palm piece includes a palm face portion and finger stall portions and comprises a sheet of leather prepared by a chrome tanning process to facilitate reduced oil content and having moisture absorption properties so as to prevent perspiration buildup on the hand of a wearer thereby reducing slippage of the glove against the hand of a wearer, said sheet of leather having an average thickness of approximately 2.0 millimeters; and a substantially continuous layer of silicone sealant having an average thickness of approximately 0.4 millimeters and bonded to a substantial portion of said palm piece for imparting improved durability, comfort, gripping, tactile and flexibility properties to said palm piece and preventing the passage of moisture therethrough, said sealant only partially penetrating said palm piece so as not to come in contact with the hand of the wearer.

2. The glove of claim 1 wherein said palm piece further includes an inside surface having a grain finish and an outside surface having a split finish to enhance the bonding of said sealant layer to said palm piece.

3. The glove of claim 1 wherein said palm piece comprises a sheet of synthetic suede material.

4. The glove of claim 1 wherein said layer covers only said palm face portion of said glove.

5. The glove of claim 1 wherein said palm piece comprises a sheet of synthetic leather material.

6. The glove of claim 1 wherein said sheet of leather has an average thickness not exceeding approximately 1.0 millimeters, and said layer of silicone sealant has an average thickness not exceeding approximately 0.2 millimeters.

* * * * *